US005739642A

United States Patent [19]

Peng et al.

[11] Patent Number: 5,739,642

[45] Date of Patent: Apr. 14, 1998

[54] LOW POWER CONSUMPTION DRIVING METHOD FOR FIELD EMITTER DISPLAYS

[75] Inventors: Chao-Chi Peng, Chupei; Chun-Hui Tsai, Hsinchu; Tzung-Zu Yang, Chutung, all of Taiwan

[73] Assignee: Industrial Technology Research Institute, Hsinchu, Taiwan

[21] Appl. No.: 566,647

[22] Filed: Dec. 4, 1995

[51] Int. Cl.[6] ..... G09G 3/10

[52] U.S. Cl. ..... 315/169.3; 315/169.1; 345/76

[58] Field of Search ..... 315/169.1, 169.3, 315/167, 349, 58; 345/74, 76, 77, 78, 84

[56] References Cited

U.S. PATENT DOCUMENTS 5,283,500 2/1994 Kochanski ..... 315/58
5,300,862 4/1994 Parker et al. ..... 315/169.1
5,313,140 5/1994 Smith et al. ..... 315/169.1
5,384,517 1/1995 Uno ..... 315/169.3
5,387,844 2/1995 Browning ..... 315/169.3
5,404,081 4/1995 Kane et al. ..... 315/169.1
5,578,906 11/1996 Smith ..... 315/169.3

*Primary Examiner*—Robert Pascal
*Assistant Examiner*—David Vu
*Attorney, Agent, or Firm*—George O. Saile; Stephen B. Ackerman

[57] ABSTRACT

A display element selection timing method applied in conjunction with an array of Field Emission Devices employs circuitry to select the elements of the array of Field Emission Devices such that the power dissipation in the array of Field Emission Devices and its attendant circuitry is minimized and the brightness is not degraded significantly.

16 Claims, 5 Drawing Sheets

FIG. 1 — Prior Art

FIG. 2 – Prior Art

LOW POWER CONSUMPTION DRIVING METHOD FOR FIELD EMITTER DISPLAYS

BACKGROUND OF INVENTION

1. Field of Invention

The present invention relates generally to cathodoluminescent display devices and more particularly to a driving method for field emission electron emitters.

2. Background of the Invention

Cathodoluminescent field emission display devices are well known in the art and are commonly referred to as FEDs as disclosed in U.S. Pat. No. 5,313,140 (Smith, et al.), U.S. Pat. No. 5,387,844 (Browning), and U.S. Pat. No. 5,283,500 (Kochanski). Other display devices such as electroluminescent displays disclosed by U.S. Pat. No. 5,384,517 (Uno) and Liquid Crystal Displays are well known alternatives to the FED.

As is disclosed in U.S. Pat. No. 5,300,862 (issued Apr. 5, 1994 to N. Parker and J. Jaskie, for "Row Activating Method for FED Cathodoluminescent Display Assembly", incorporated herein by reference)

"FIG. 1 is a partial perspective view representation of an image display device 100 as configured in accordance with the present invention. A supporting substrate 101 has disposed thereon a first group of conductive paths 102. An insulator layer 103 having a plurality of apertures 106 formed there through is deposited on supporting substrate 101 and on the plurality of conductive paths 102. Apertures 106 have disposed therein electron emitters 105 which electron emitters 105 further disposed on conductive paths 102 A second group of conductive paths 104 is disposed on insulating layer 103 and substantially peripherally about apertures 106. An anode 110, a viewing screen 107 having disposed thereon a cathodoluminescent material 108, is distally disposed with respect to electron emitters 105. An optional conductive layer 109 is disposed on the cathodoluminescent material (phosphor) 108, as shown, or layer 108 may be positioned between the viewing screen 107 and the phosphor 108.

Each conductive path of the first group of conductive paths 102 is operably coupled to electron emitters 105 which are disposed thereon. So formed, electron emitters 105 associated with a conductive path of the first group of conductive paths 102 may be selectively enabled to emit electrons by providing and electron source operably connected to the conductive path.

Each conductive path of the second group of conductive paths 104 is disposed peripherally about selected aperture 106 in which electron emitters 105 are disposed. So formed, electron emitters 105 associated with a conductive path of the second group of conductive paths 104 is induced to emit electrons provided that the conductive path of the second group of conductive paths 104 is operably connected to a voltage source (not shown) to enable the emission from the associated electron emitters 105 and the conductive path of the first group of conductive paths 102 to which electron emitters 105 are coupled is operably connected to an electron source (not shown).

Each aperture 106 together with the electron emitter 105 disposed therein and a conductive path of the first group of the plurality of conductive paths 102 on which the electron emitter 105 is disposed and to which the electron emitter 105 is operably coupled and an extraction electrode, including a conductive path of the second group of conductive paths 104 peripherally disposed there about, comprises a field emission device (FED). While the structure of FIG. 1 depicts an array of four FEDs, it should be understood that arrays of FEDs may comprise many millions of FEDs.

Selectively applying voltage to an extraction electrode of an FED and selectively operably connecting an electron source to a conductive path operably coupled to electron emitter 105 of the FED will result in electrons being emitted into a region between electron emitter 105 and distally disposed anode 110. Electrons emitted into this region traverse the region to strike anode 110 provided a voltage (not shown) is applied to anode 110. Each FED or, as desired, group of FEDs or the array of FEDs provides electrons to a determinate portion of phosphor 108. Such a determined portion of phosphor 108 is termed a picture element (pixel) and is the smallest area of the viewing screen which can be selectively controlled."

As also disclosed in the '862 patent and shown in FIG. 2 (FIG. 3 of '862 patent) "is a schematic representation of an image display 300 employing an array of FEDs wherein extraction electrodes 304B correspond to a first group of conductive paths and emitter conductive paths 304A correspond to a second group of conductive paths. In this embodiment, first and second groups of conductive paths 304B and 304A, respectively, make up a plurality of conductive paths. Appropriately energized, as described previously with reference to FEDs of FIG. 1, the FEDs selectively emit electrons. In the schematic depiction of FIG. 2 controlled current source 301A–301D is operably connected between each of the second group of conductive paths 304A and a reference potential, such as ground, to provide a determinate source of electrons to electron emitters 305 operably connected thereto. Each extraction electrode 304B is operably coupled to one output terminal of a plurality of output terminals 316 of switching circuit 302. A voltage source 303 is operably connected between an input terminal 311 of switching circuit 302 and a reference potential, such as ground.

By selectively controlling the desired level of electrons provided by controlled constant current sources 301A–301D and by selectively switching voltage source 303 to a selected output terminal of the plurality of output terminals 316 a row of FEDs is simultaneously energized and the electron emission from each FED of the row is determined. By providing that switching circuit 302 connects voltage source 303 to a single extraction electrode in a single row of FEDs the electron current prescribed by controlled constant current source 301A–301D operably coupled thereto.

Switching circuit 302 is realized by any of many means known to the art such as, for example, mechanical and electronic switching. In some anticipated applications it will be desired that the switching function realized by the switching circuit will be cyclic (periodic recurring) and sequential. Such a switching function, when applied to an image display employing an array of FEDs as described herein, provides for row by row addressing of viewing screen pixels."

From FIG. 3 the amount of time in which each FED element is activated is typically the amount of time for each scan cycle $t_f$ 510 divided by the number of scan lines n or rows in FIG. 2 304B. The power consumption of the display element and the activation circuitry 301A–301D, 302, 303, 306, and 310 is linearly proportioned to the amount of time the FED element is activated.

SUMMARY OF THE INVENTION

An object of the invention is a method to minimize the excess power consumption of the prior art.

This object is met through the provision of a method for selectively enabling of an image display. The first step is to provide an FED display which has a plurality of FED emitters arranged in a regular pattern of columns and rows. Furthermore the FED display has anode means onto which a layer of phosphorescent material is disposed. A voltage source is coupled to the anode. Coupled to each of the columns of the field emitters is a current source means. The second step is to provide a current source activation circuit to activate each current source in a sequential manner so as to activate each column of the field emitters. The third step is to provide a gate activation circuit to selectively apply a voltage to each gate electrode sequentially to stimulate each field emitter to emit an electron current.

The period of time at which the gate activation circuit applies a voltage to each gate electrode of the plurality of gate electrodes for a period of time sufficiently long as to stimulate the emission of light from the phosphorescent material and no longer to conserve power in the FED display and attendant circuitry.

DETAILED DESCRIPTION OF THE INVENTION

Figure 3:
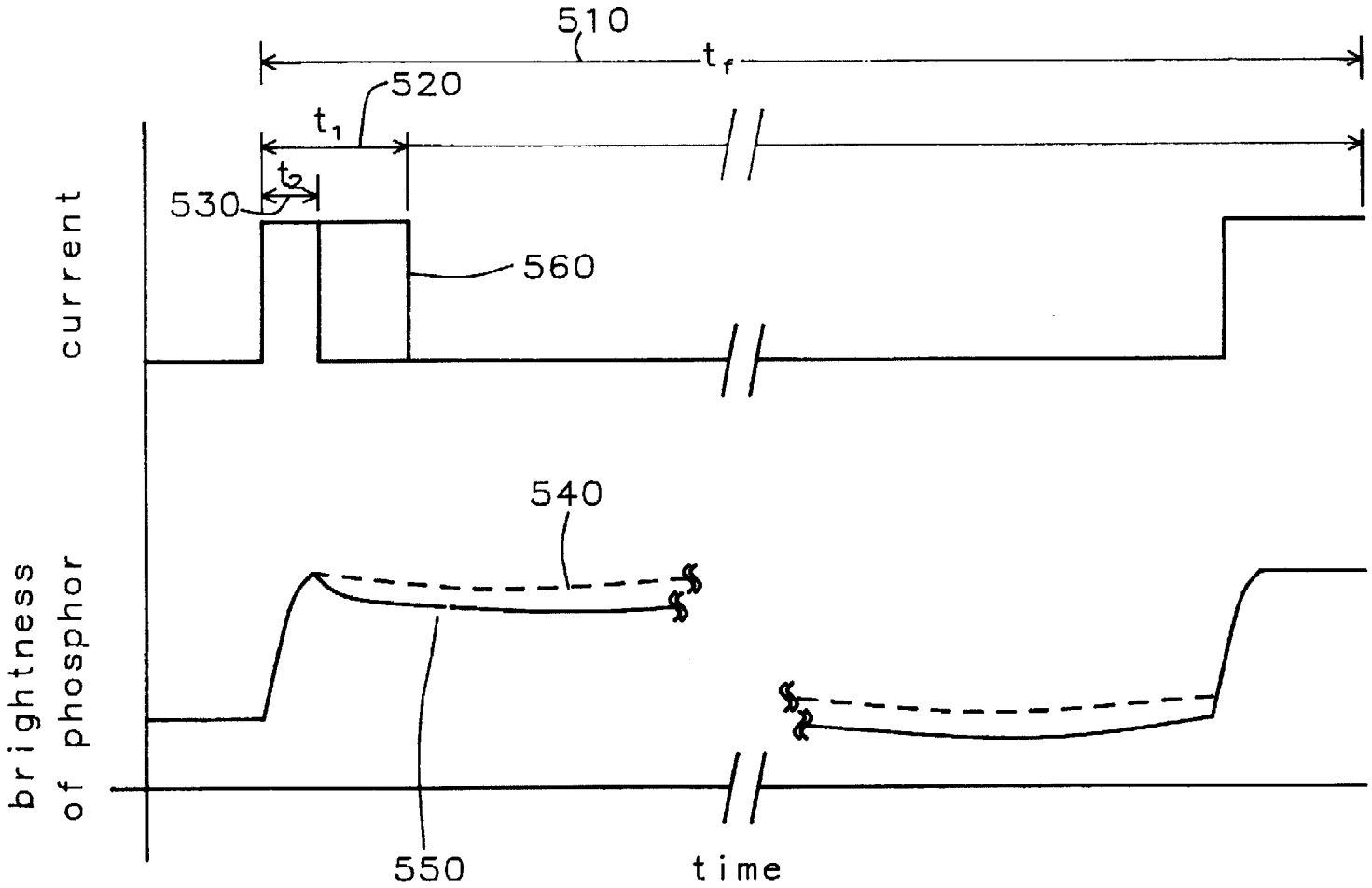
FIG. 3. is a graphical representation of the timing of the typical method for selection of an image display element in prior art versus this invention and it effect on brightness The current source control circuitry 320 will selectively activate one of the current sources 301A–301D to create the flow of electron current from the electron emitters 305 as controlled by the conductive paths 104 which form gate electrodes.

Cathodoluminescent materials (phosphors) are known to be excited to emit photons by the impingement of energetic electrons. FIG. 3 depicts a graphical representation 540 of a common response characteristic wherein the luminous output of the phosphor is stimulated by the current 560 impinged upon the phosphor. If the time of the current pulse $t_1$ 520 is modified to time period $t_2$ 530, it can be shown that the degradation of the brightness of the phosphor is reduced brightness $b_1$ 540 to brightness $b_2$ 550. In typical applications this degradation is on the order of 1%.

Figure 1:
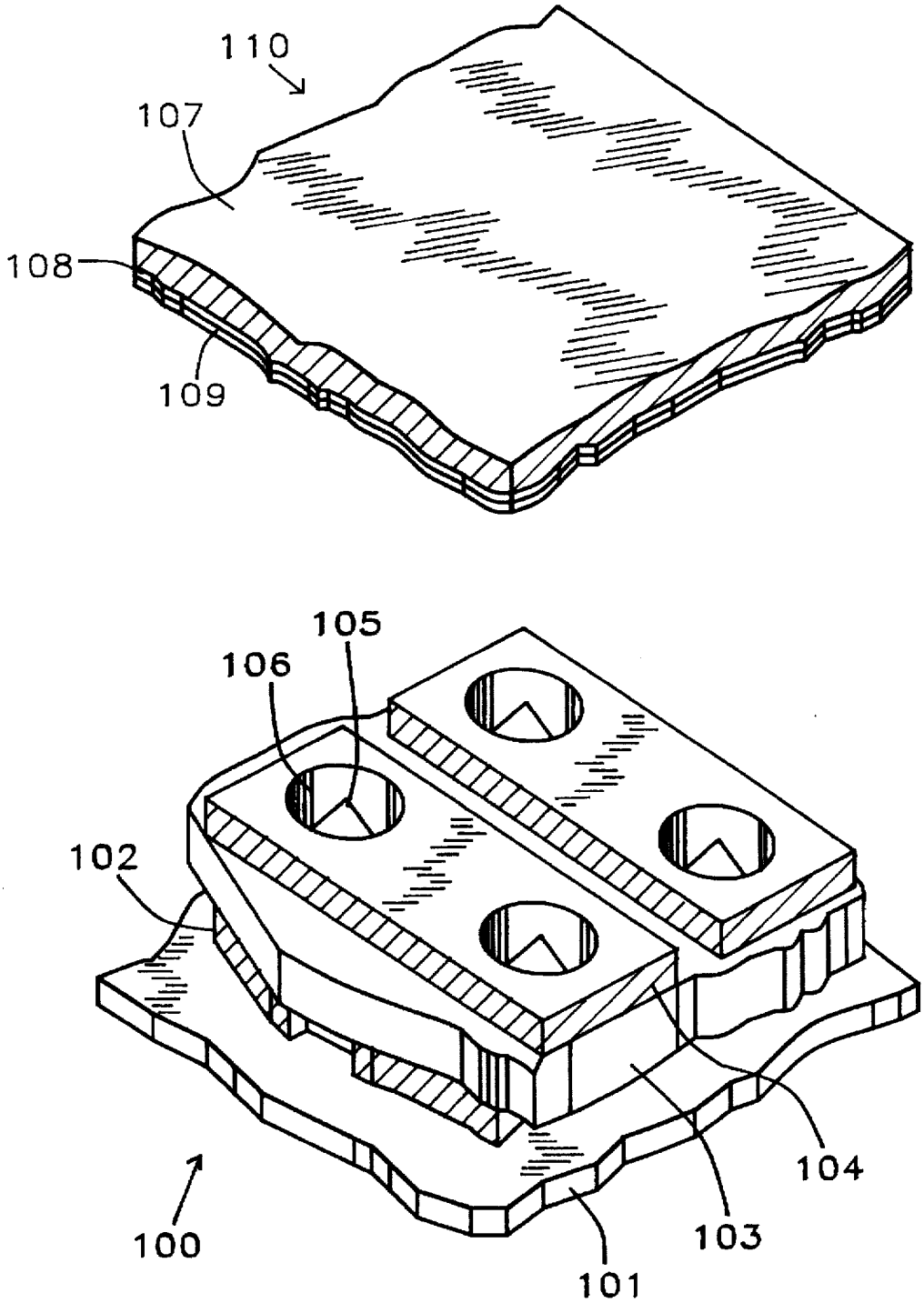
FIG. 1. is a partial perspective of an embodiment of an image display employing field emission device electron sources as described in U.S. Pat. No. 5,300,862.
Figure 2:
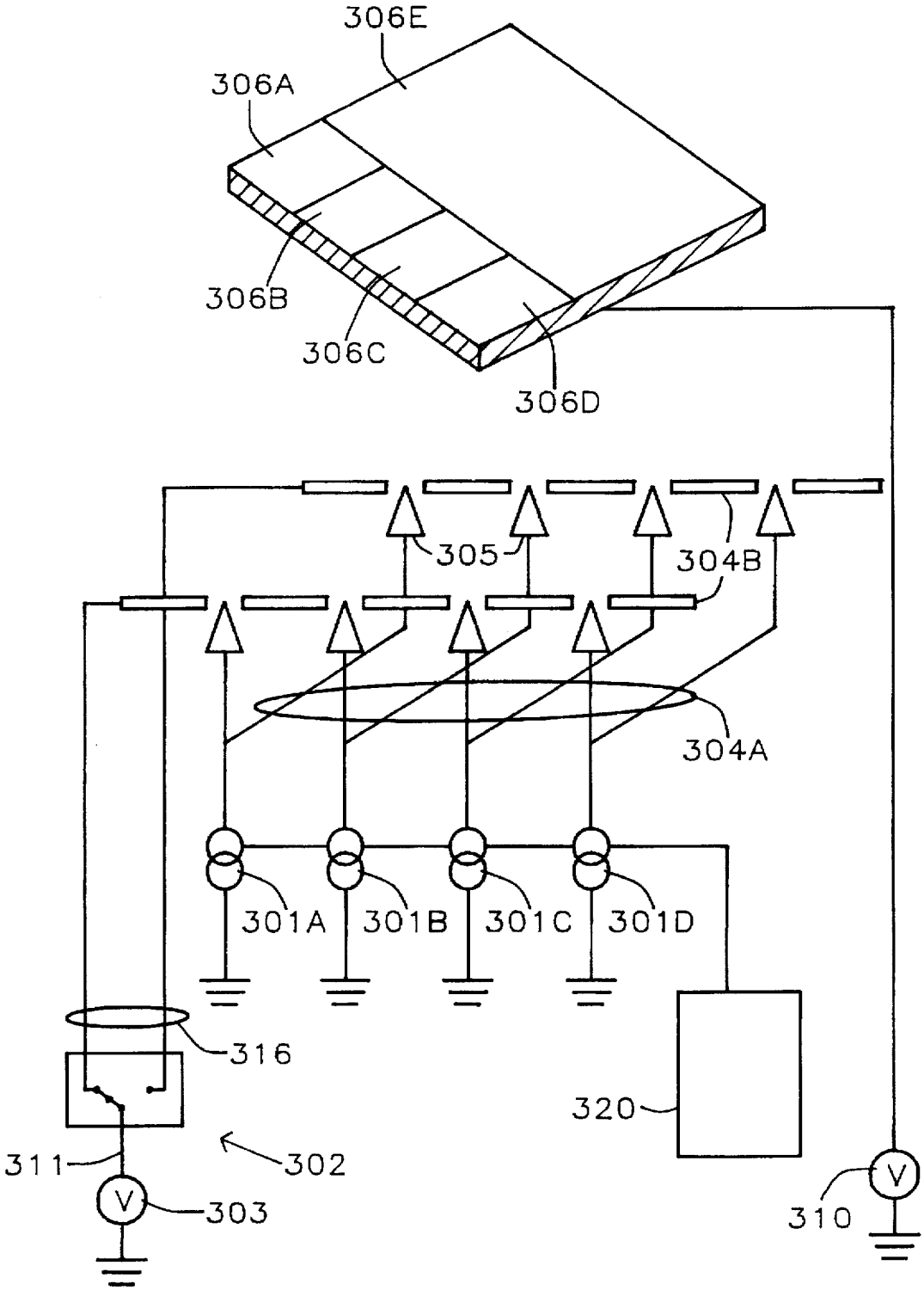
FIG. 2. is a schematic representation of an image display employing the activation method in accordance with U.S. Pat. No. 5,300,862.
Figure 4:
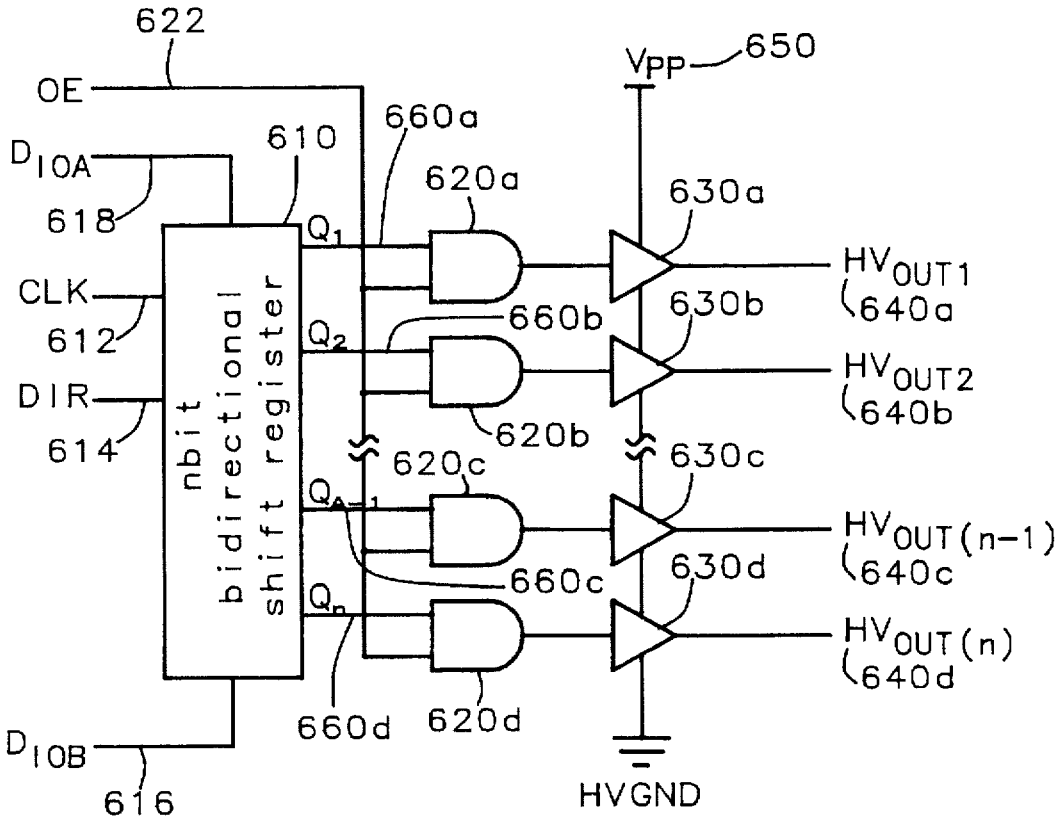
FIG. 4. is a schematic representation of an embodiment of the image display element selection circuitry of this invention.

In an FED as in FIG. 2 the time at which each of the second group of conductive paths 304B which are configured as gate electrodes to control the flow of the electron current, is selected as determined by the method of activation of switch 302, which will be described hereinafter as the gate activation circuit. Typically this time of activation is divided equally among the rows 304B of the second group of conductors. As is shown in FIG. 3. if the activation time is shortened to $t_2$ 530 the amount of current and therefore the amount of power consumed by the FED and its attendant circuitry can be decreased while the brightness of the emission is only decreased from $b_1$ 540 to $b_2$ 550. In the gate activation circuit as shown in FIG. 4, each row of the set of conductive paths from FIG. 2 304B is operably connected to the outputs {HVout1 640*a*, HVout2 640*b*, . . . . HVoutn-1 640*c*, HVoutn 640*d*}. The level shift and output drivers 630*a* through 630*d* provide the attachment to the voltage source Vpp 650 which provides the correct potential to cause the emission of electrons from the emitter tips of FIG. 1 105. The turning ON and OFF of the level shift and output drivers 630*a* through 630*d* is controlled by the logical AND circuits 620*a* through 620*d*. The bi-directional shift register 610 sequentially and cyclically activates on of its outputs {$Q_1$ 660*a*, $Q_2$ 660*b*, . . . . $Q_{n-1}$ 660*c*, $Q_n$ 660*d*}. The period of activation of the bi-directional shift register 610 is determined by the clock CLK 612. The selection of the sequence of the activation of the outputs {$Q_1$ 660*a*, $Q_2$ 660*b*, . . . . $Q_{n-1}$ 660*c*, $Q_n$ 660*d*} is determined by the signal at either input $D_{10A}$ 618 or $D_{10A}$ 616. This will allow for a unique pattern of selection, but typically a single output {$Q_1$ 660*a*, $Q_2$ 660*b*, . . . . $Q_{n-1}$ 660*c*, $Q_n$ 660*d*} of the bi-directional shift register 610 will be selected. The signal output enable OE 622 has a period that will determine the period of activation for the level shift and output drivers 630*a* through 630*d*.

Figure 5:
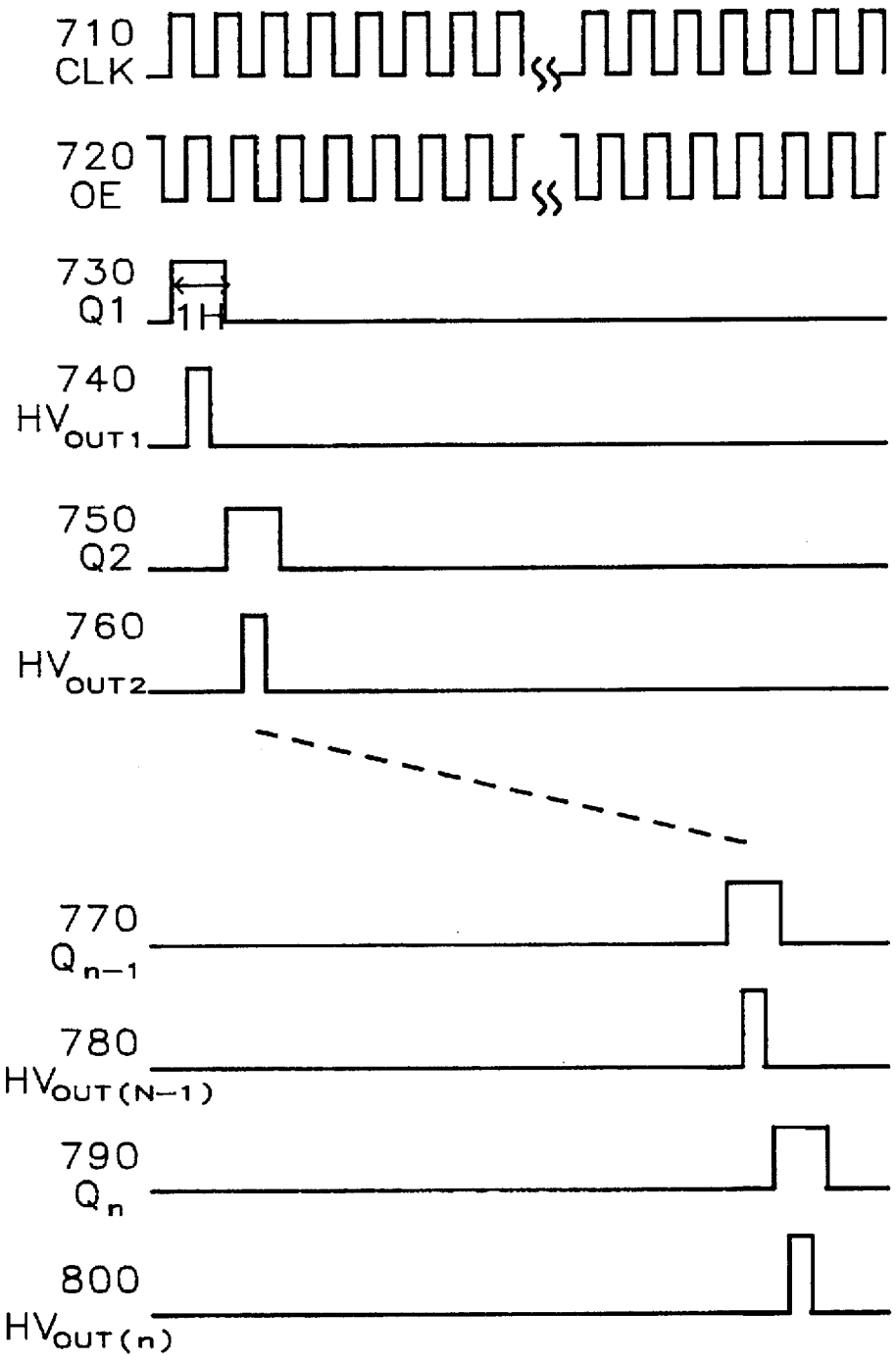
FIG. 5. is a graphical representation of the timing of the image display selection method of this invention.

FIG. 5. is a graphical representation of the timing of the activation of the output (FIG. 4 {HVout1 640*a*, HVout2 640*b*, . . . . HVoutn-1 640*c*, HVoutn 640*d*}). The clock 710 is a continuous cyclic pulse to synchronize the activation of the output $Q_1$ 730, $Q_2$ 750, . . . . $Q_{n-1}$ 770, $Q_n$ 790 of the bi-directional shift register (FIG. 4. $Q_1$ 660*a*, $Q_2$ 660*b*, . . . . $Q_{n-1}$ 660*c*, $Q_n$ 660*d*). The period of the output enable OE 720 and the time in the sequence of the output of the bi-directional shift register $Q_1$ 730, $Q_2$ 750, . . . . $Q_{n-1}$ 770, $Q_n$ 790 determine the sequence and the period of the output {HVout1 740, HVout2 760, . . . . HVoutn-1 780, HVoutn 800}. This control of the period of the output is adjusted to minimize the power consumption of the FED display and its attendant circuitry (FIG. 2).

What is claimed:

1. A method for the enabling of an image display comprising the steps of:

a) providing an FED display comprising a plurality of field emitters arranged in a regular pattern of column and rows, a plurality of gate electrodes with each gate electrode aligned with each row of the plurality of field emitters, an anode means onto which a layer of phosphorescent material is disposed, a voltage source coupled to the anode means, and a plurality of current source means such that each current source is coupled to the field emitters aligned in each column of the plurality of field emitters;

b) providing a current source activation circuit to activate each current source in a sequential manner so as to activate each column of the plurality of field emitters; and c) providing a gate activation circuit to selectively apply a voltage to each gate electrode sequentially to stimulate each field emitter to emit an electron current for a period of time sufficiently small as to minimize power consumption, whereby said gate activation circuit comprises:

a synchronization means to time the selection of each gate of plurality of gates of an FED display, a gate selection means to determine if any gate of the plurality of gates is to be activated, a plurality of gate driving means, each of which is coupled to each gate of the plurality of gates for a period of time to provide a voltage to each gate of said plurality of gates to activate the emission of light from the FED display, and an output enabling means coupled to the gate driving means to limit the period of time the voltage is provided to each gate of the plurality of gates.

2. The method of claim 1 wherein the electron current impinges upon the phosphorescent material so that the phosphorescent material will emit light.

3. The method of claim 1 wherein the current source activation means and the gate activation means are operative for a sufficient period of time necessary as to stimulate the emission of light.

4. The method of claim 1 wherein each current source is selected sequentially for activation at a first rate so as to select the columns of field emitters.

5. The method of claim 1 wherein each gate electrode has a voltage applied to it at a second rate such that each row of field emitters can emit the electron current.

6. The method of claim 1 wherein the synchronization means is coupled to the gate selection means to sequentially time the selection of each of the gates of the plurality of gates.

7. The method of claim 1 wherein the gate selection means is coupled independently to each of the plurality of gate driving means to select each gate driving means.

8. The method of claim 1 wherein the output enabling means minimizes power dissipated by the FED display by minimizing the time at which each gate driving means is activated.

9. An FED display comprising:

a) a plurality of field emitters arranged in a regular pattern of column and rows;

b) a plurality of gate electrodes with each gate electrode aligned with each row of the plurality of field emitters;

c) an anode means onto which a layer of phosphorescent material is disposed;

d) a voltage source coupled to the anode means e) a plurality of current source means such that each current source is coupled to the field emitters aligned in each column of the plurality of field emitters;

f) a current source activation circuit to activate each current source in a sequential manner so as to activate each column of the plurality of field emitters; and g) a gate activation circuit to selectively apply a voltage to each gate electrode sequentially to stimulate each field emitter to emit an electron current for a period of time sufficiently small as to minimize power consumption, whereby said gate activation circuit comprises:

a synchronization means to time the selection of each gate of plurality of gates of an FED display, a gate selection means to determine if any gate of the plurality of gates is to be activated, a plurality of gate driving means, each of which is coupled to each gate of the plurality of gates for a period of time to provide a voltage to each gate of said plurality of gates to activate the emission of light from the FED display, and an output enabling means coupled to the gate driving means to limit the period of time the voltage is provided to each gate of the plurality of gates.

10. The FED display of claim 9 wherein the electron current impinges upon the phosphorescent material so that the phosphorescent material will emit light.

11. The FED display of claim 9 wherein the current source activation means and the gate activation means are operative for a sufficient period of time necessary as to stimulate the emission of light.

12. The FED display of claim 9 wherein each current source is selected sequentially for activation at a first rate so as to select the columns of field emitters.

13. The FED display of claim 9 wherein each gate electrode has a voltage applied to it at a second rate such that each row of field emitters can emit the electron current.

14. The FED display of claim 9 wherein the synchronization means is coupled to the gate selection means to sequentially time the selection of each of the gates of the plurality of gates.

15. The FED display of claim 9 wherein the gate selection means is coupled independently to each of the plurality of gate driving means to select each gate driving means.

16. The FED display of claim 9 wherein the output enabling means minimizes power dissipated by the FED display by minimizing the time at which each gate driving means is activated.

* * * * *